US012709847B2

(12) United States Patent
Obr et al.

(10) Patent No.: US 12,709,847 B2
(45) Date of Patent: Aug. 18, 2026

(54) METHOD AND DEVICE FOR MILLING THE SURFACE OF A TRAFFIC AREA IN AT LEAST TWO LAYERS

(71) Applicant: Exact Control System a.s., Prague (CZ)

(72) Inventors: Vitezslav Obr, Trebic (CZ); Marek Prikryl, Velka Chuchle (CZ)

(73) Assignee: Exact Control System A.S., Prague (CZ)

( * ) Notice: Subject to any disclaimer, the term of this patent is extended or adjusted under 35 U.S.C. 154(b) by 0 days.

(21) Appl. No.: 18/832,772

(22) PCT Filed: Jan. 24, 2023

(86) PCT No.: PCT/CZ2023/000002
§ 371 (c)(1),
(2) Date: Jul. 24, 2024

(87) PCT Pub. No.: WO2023/151729
PCT Pub. Date: Aug. 17, 2023

(65) Prior Publication Data

US 2025/0101694 A1 Mar. 27, 2025

(30) Foreign Application Priority Data

Feb. 9, 2022 (CZ) ..... CZ2022-62

(51) Int. Cl.
*E01C 23/088* (2006.01)
*E01C 23/01* (2006.01)

(52) U.S. Cl.
CPC ..... *E01C 23/088* (2013.01); *E01C 23/01* (2013.01)

(58) Field of Classification Search
CPC ..... E01C 23/12; E01C 23/088; E01C 23/01; G05B 17/02
See application file for complete search history.

(56) References Cited

U.S. PATENT DOCUMENTS 6,047,227 A * 4/2000 Henderson ..... E02F 9/2045 701/50
6,371,566 B1 * 4/2002 Haehn ..... E01C 19/004 299/1.5

(Continued)

FOREIGN PATENT DOCUMENTS

CN 113005868 A * 6/2021 ..... E01C 19/004
CN 120099843 A * 6/2025 ..... G01B 11/24
EP 2806066 A1 4/2016

OTHER PUBLICATIONS

PCT Search Report and Written Opinion dated Apr. 12, 2023 for related PCT Patent Application No. PCT/CZ2023/000002, 10 pages.

*Primary Examiner* — Frederick L Lagman
(74) *Attorney, Agent, or Firm* — Hovey Williams LLP; Paul J. Walker

(57) ABSTRACT

A method of milling the surface of the traffic area in at least two layers, in which the first layer is milled and at the same time the spatial position (X, Y, Z) of the road milling machine and the cross slope of the milling drum are measured continuously at each moment of milling the first layer, and the measured data is stored in the database of a 3D guidance computer. From the stored measured data representing the spatial positions (X, Y, Z) of the road milling machine and the cross slopes of the milling drum, a digital 3D model of the surface of the traffic area after milling the first layer is calculated in the 3D guidance computer. Subsequently, after milling the first layer using the digital 3D model of the surface of the traffic area after milling the first layer and the obtained digital 3D model of the desired target surface of the traffic area or obtained the digital differential model of the milling depths, at least the second layer is milled. The device for performing the method is also described.

8 Claims, 2 Drawing Sheets

(56) References Cited

U.S. PATENT DOCUMENTS

| | | | | |
|---|---|---|---|---|
| 7,144,191 | B2 * | 12/2006 | Kieranen | E01C 19/40 701/50 |
| 8,961,065 | B2 | 2/2015 | Snoeck et al. | |
| 10,191,183 | B2 * | 1/2019 | Prikryl | G01S 19/24 |
| 2007/0214687 | A1 * | 9/2007 | Woon | E02F 3/842 701/50 |
| 2020/0032464 | A1 | 1/2020 | O'Donnell | |
| 2020/0122540 | A1 * | 4/2020 | Rife, Jr. | B62D 55/116 |
| 2021/0189667 | A1 * | 6/2021 | Fritz | E01C 23/088 |

* cited by examiner

METHOD AND DEVICE FOR MILLING THE SURFACE OF A TRAFFIC AREA IN AT LEAST TWO LAYERS

RELATED APPLICATIONS

This application is the National Stage of International Patent Application No. PCT/CZ2023/000002, filed Jan. 24, 2023, which is hereby incorporated herein by reference in its entirety, and which claims priority to Czech Patent Application No. PV 2022-62, filed Feb. 9, 2022, which is also incorporated herein by reference in its entirety.

TECHNICAL FIELD

The invention relates to a method and device for milling the surface of a traffic area in at least two layers.

BACKGROUND ART

During its life cycle, the road surface is exposed to a number of influences that change its structural and geometric properties. The most common negative manifestations of changes in the geometry of the road surface are ruts, potholes, dips, cracks (hereinafter referred to as "road defects"). From the point of view of the road user, they mainly lead to a reduction in the smoothness of driving, to an Increase in the vibrations of the whole vehicle, to a reduction in the dynamic stability of the vehicle and to insufficient drainage of the road surface.

Repair by replacing the top damaged layer is carried out in such a way that the top layer of material of a certain thickness is first removed from the damaged road surface, containing road defects, when the road milling machine gradually mills the surface of the traffic area in longitudinal passes, which have a width corresponding to the width of the milling drum and which are parallel to the direction of travel of vehicles, while these milled passes connect to each other with an overlap of a minimum width of 5 to 10 cm. In this process, the entire surface of the road is gradually milled away. A new asphalt, concrete or other so-called construction layer is then laid on the resulting milled surface. The thickness of the new construction layer should ideally be constant across the entire repair area. Different thicknesses of the new structural layer cause the reappearance of unevenness due to the different compressibility of layers of different thicknesses.

Therefore, it is the endeavour of road milling machine operators to smooth out all Irregularities by milling and the resulting milled surface ensures maximum smoothness of driving in the longitudinal direction and road drainage and safe cross slope.

To achieve the desired surface topography of the road construction layer after milling or paving, three principle procedures are used.

The first principle is the fully manual control of the setting of depths and cross-slopes of milling or thickness and cross-slopes of paving (hereinafter referred to as "working parameters"), where the operator of the construction machine manually sets the working parameters and these values are maintained until the target values of the parameters are manually changed. The change of working parameters takes place on the basis of the obtained information or the estimation of the situation in order to achieve the required topography of the resulting traffic area.

The disadvantage of this method of milling with a constant depth over the entire surface of the traffic area is that it only copies or averages existing unevenness, correct smaller unevenness such as potholes, but cannot fully remove unevenness longer than a few meters, usually longer than 2 metres. Furthermore, it cannot correct or change existing cross slopes, it only copies them.

The second principle is automatic or semi-automatic input, when the required work parameters of the construction machine are calculated or analogically set based on the information obtained by the work tool, for example, a road milling machine or a paver, at the work site within the same work travel from contact or non-contact measuring devices connected to the working tool. The setting of the working parameters is carried out simultaneously with the measurement. This is, for example, the Wirtgen multiplex device known from document EP054737881, or an analogue touch system using pre-prepared guiding steel wires (so-called string lines) to ensure the required depths, thicknesses and slopes, or an artificial reference laser plane is used to ensure flatness using a stationary rotary laser. These methods are described in detail in document EP0964958B1.

The disadvantage of this method of milling is that it repairs the road only on the basis of immediately available information from measurements taken at that moment from the immediate vicinity of the road milling machine. It does not address the overall topography over the entire length and width of the section of road being repaired, for which 3D information from the entire repair area is necessary. Averaging methods, such as those used by Wirtgen's Multiplex machine, cannot correct deformations greater than the length of the averaging, which is usually limited by the length of the road milling machine and practically does not exceed 10 metres. The method using a rotating laser is limited by the range, the condition of direct visibility between the transmitter and the receiver of the laser signal and the accuracy of the device. The string lines requires time-consuming preparation and makes it impossible to change the planned location and direction of milling, which may be required, for example, by a change in the traffic situation during construction.

The third principle, the most technically advanced, the so-called 3D milling, also known under the more general name of remote guidance of construction machines such as road milling machine or paver (in English, the abbreviation AMG—Automated Machine Guidance), is the automatic adjustment of depths and slopes of milling or paving based on a pre-prepared 3D digital terrain model of the surface of the construction layer and the determined spatial position of the construction machine. Such 3D milling can take place over the entire width and length of the road, fully automatically. One variant of such a device is known from document U.S. Pat. No. 8,961,065B2 or a more complex solution from document U.S. Pat. No. 10,066,346B2.

Two basic methods of 3D milling are known.

The first method of 3D milling, so-called profile milling, uses absolute guidance of the road milling machine, where the absolute X, Y, Z coordinates of the road milling machine are determined using a total station (e.g. Trimble/SITECH technology) or a combination of GNSS and laser levelling instrument (e.g. Topcon mmGPS) in a road milling machine independent coordinate system (e.g. UTM coordinate system with ellipsoidal heights), in which the target road surface after milling is designed. Based on the height difference of the road milling machine, specifically the working part of the milling drum, and the height of the s target designed surface after milling at the X, Y location of the road milling machine, the absolute height of the milling drum is set (e.g. Topcon mmGPS or Trimble/SITECH 3D milling).

The second method of 3D milling is the so-called differential milling, where the surface of the conveying surface is first 3D measured before milling, the 3D design of the target surface after milling is designed and a differential milling depth model is calculated from the differences in the heights of these surfaces. During milling, only the horizontal position of the road milling machine (X, Y), such as the milling drum or the X,Y position of the unmilled surface of the areas adjacent to the lower right and left sides of the milling drum, is determined, and the corresponding milling depth Ft (X, Y) from the surface of the unmilled surface is determined using the differential model. This information is passed to the road milling machine control computer, which makes the necessary adjustments to the milling machine hydraulics to achieve the desired milling depth from the known surface. Such a method is described, for example, in document U.S. Pat. No. 8,961,065B2.

The described well-known 3D machine guidance has the following disadvantages.

It requires the surface of the unmilled road to be accurately 3D surveyed before repair, which is time-consuming, logistically and financially demanding.

To obtain data on the road surface before repair, it uses non-contact measuring devices, mainly 2D or 3D laser scanners, which are firstly very expensive and secondly their accuracy is affected by physical variables such as pressure, temperature or humidity of the atmosphere.

The measurement usually takes place during traffic, which causes restrictions on road traffic, and from the 3D measurement of the X, Y, Z surface, all 3D data that do not represent the surface of the road must be filtered out, especially means of transport, traffic cones, leaves, dirt, snow, which increases the time and financial claims for the implementation of the repair.

To capture all the unevenness, it is necessary to measure the surface at a high density of hundreds to thousands of points per square meter, which increases the demands of working with the data, such as data transfer and data processing.

It requires time and cost consuming processing of 3D measured points into 3D digital models of the road surface before milling and 3D digital designed models of the road after milling. Such processing takes days to months and requires experts in 3D data processing.

During the data processing it is necessary to define the area to be modified by the road milling machine, in particular it is necessary to define the edges of the road surface, road islands and break lines of cross slopes, especially the road crown.

The common disadvantage of all known methods is that they do not solve the optimization of the burden on the environment by milling in two layers, where by setting the milling depths of the first abrasive layer and optimizing the milling volume of the second bed layer, the separation of materials of different quality for other subsequent uses, such as recycling, is achieved.

The goal of the solution according to the invention is to propose such a solution which would eliminate the disadvantages of the state of the art.

SUMMARY OF THE INVENTION

The stated goal is achieved by milling the surface of the traffic area in at least two layers, according to the invention, the essence of which is that the first layer is milled and at the same time the spatial position (X, Y, Z) of the road milling machine and the cross slope of the milling drum are continuously measured at each moment of the milling of the first layer and the measured data are stored in the database of the 3D guidance computer.

From the stored measured data representing the spatial positions (X, Y, Z) of the road milling machine and the cross slopes of the milling drum, a digital 3D model of the road surface after the first layer has been milled is calculated in the 3D guidance computer.

Subsequently, after milling the first layer, at least a second layer is milled using the digital 3D model of the surface of the traffic area after milling the first layer and the obtained digital 3D model of the desired target surface of the traffic area after the milling part of the repair.

According to an advantageous embodiment, in addition to the information about the spatial position (X, Y, Z) of the road milling machine and the cross slopes of the milling drum, information about the relative positional changes of the road milling machine from an inertial navigation system placed on the road milling machine is also used to calculate a digital 3D model of the surface of the traffic area after the first layer has been milled.

According to another advantageous embodiment, to calculate the digital 3D model of the surface of the traffic area after milling the first layer, in addition to the information on the spatial position (X, Y, Z) of the road milling machine and the cross slopes of the milling drum, information on the relative longitudinal height profile of the original degraded, unmilled surface of the road is also used or information about the relative longitudinal height profile of the surface of the traffic area after milling the first layer of material, which are continuously measured during milling, for example, by the Wirtgen multiplex system.

Relative longitudinal height profile means the height profile of the surface of the traffic area measured in the milling direction of the road milling machine, which is related to a general inclined reference plane or straight line, which may not be exactly horizontal, and which does not have an indication of its altitude or height related to an independent coordinate system on the road milling machine.

According to yet another advantageous embodiment, in addition to the information on the spatial position (X, Y, Z) of the road milling machine and the cross slope of the milling drum, information on the travel speed and rotation of the crawler sliders or road milling machine wheels is also used to calculate the digital 3D model of the surface of the traffic area after milling the first layer, which are transmitted via the communication interface from the control computer of the road milling machine to the 3D guidance computer or are obtained from external sensors, such as an odometer, which are connected to the 3D guidance computer.

It is advantageous if, before milling the second layer, the calculated digital 3D model of the surface of the traffic area after milling the first layer is sent to the server, and in the server the digital 3D model of the desired target surface is calculated from the calculated digital 3D model of the surface of the traffic area after milling the first layer and from additional design information.

Subsequently, a digital differential model of the milling depths is calculated in the server from the digital 3D model of the surface of the traffic area after the first layer has been milled and from the digital 3D model of the desired target surface of the traffic area after the milling part of the repair, which defines the milling depth Ft (X,Y) for each X, Y coordinate.

The digital differential model of the milling depths is sent from the server and stored in the database of the 3D guidance computer.

The second layer of the traffic area is then milled, and during the milling of the second layer the 3D guidance computer obtains the horizontal coordinates (X,Y) of the road milling machine and determines the appropriate milling depth Ft (X,Y) from the digital differential model of the milling depths.

The Ft (X,Y) depth is sent to the road milling machine control computer via a communication interface and the road milling machine control computer controls the road milling machine to mill the Ft (X,Y) depth.

An advantage of the method according to the invention is that it is not necessary to perform a 3D measurement of the original degraded unmilled surface of the road before 3D milling. The 3D measurement is performed indirectly by a road milling machine at the same time as the milling of the first layer, whereby the material of the first layer of a different quality is separated and the surface is partially smoothed. From the data continuously recorded during milling of the first layer, a 3D model of the surface of the traffic area after milling the first layer is created, which is used to design a 3D model of the desired target surface of the traffic area after the milling part of the repair. By milling the second layer, optimal longitudinal flatness and cross slopes are achieved, at the same time the volume of the milled material of the second layer is controlled. This procedure achieves the separation of materials of different quality for the purposes of different subsequent uses, and at the same time optimal longitudinal flatness and cross slopes are achieved without the need to carry out a 3D survey of the original degraded unmilled surface of the traffic area. Another advantage is that this procedure enables a high degree of automation of the processing of 3D models, since a number of operations in the processing of 3D models, which according to the state of the art require the intervention of a specialist for 3D processing of models (for example, the definition of the crown of a road), can be derived from the positions of the milling passes implemented when milling the first layer.

By controlled separation of the materials of the first and second layers of the road in a way that determines the milling depths of the first layer and by 3D control of the milling depths and slopes of the second layer, a higher efficiency of recycling of the milled material is achieved than is the case with known milling methods and thus reduces construction waste during recycling roads and saves resources of natural aggregate from quarries or gravel pits. Other benefits include a total reduction in the cost of a 3D repair of a degraded roadway, a reduction in the amount of material deposited in landfills, environmental protection through smaller interventions in the landscape, a reduction in the volume of transported material, and a reduction in the overall energy demand of the repair.

The device for carrying out the method according to the invention includes a road milling machine with a milling drum and a control unit, and the road milling machine is equipped with a road milling machine position sensor and a road milling machine inclination sensor. The position sensor is connected to the 3D guidance computer, and the inclination sensor is connected to the 3D guidance computer, or to the road milling machine control computer, which is connected to the 3D guidance computer, and the 3D guidance computer is connected to a database to store the measured data, a digital 3D model of the desired target surface of the traffic area after the milling part of the repair, the 3D model of the surface of the traffic area after milling the first layer and the digital differential model of the milling depths, while a server for calculating digital 3D models is also connected to the 3D guidance computer.

According to an advantageous embodiment, the position sensor is at least one GNSS receiver, or a reflective prism on the body of the road milling machine for continuous targeting by a total station.

According to another advantageous embodiment, the position sensor includes a GNSS receiver for sensing the horizontal position of the road milling machine and a laser leveling device for sensing the vertical position of the target located on the body of the road milling machine.

According to other advantageous embodiments, the control unit is provided with a display device, or the server and the 3D guidance computer are integrated in one device, or the milling control computer and the 3D guidance computer are integrated in one device.

BRIEF DESCRIPTION OF DRAWINGS

The invention will be described in more detail using examples of a specific embodiment of the method and device according to the invention, shown in the attached drawings, in which the individual figures represent.

EXAMPLES OF EMBODIMENTS

Figure 1:
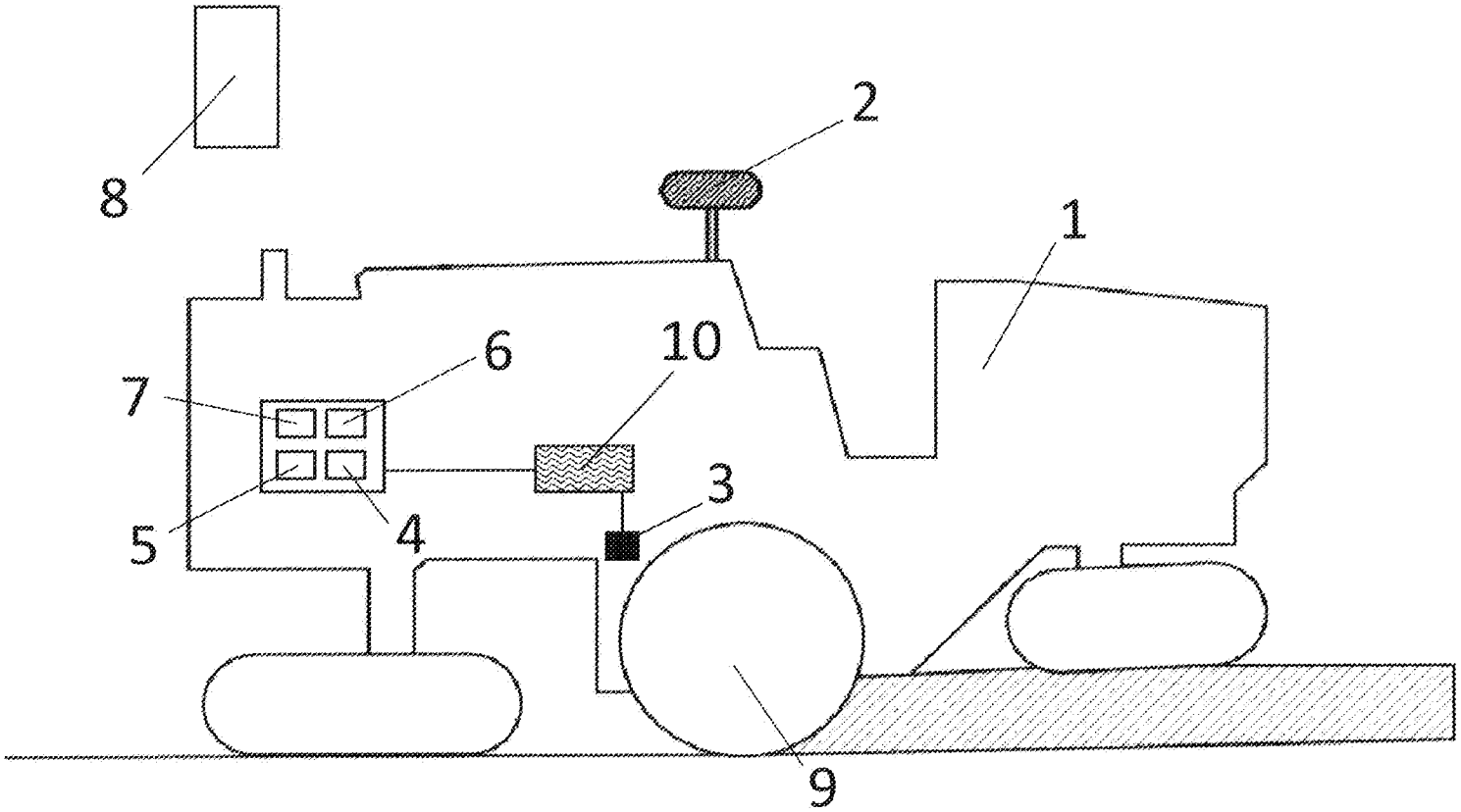
FIG. 1—schematically illustrated example of a device for carrying out the method according to the invention FIG. 2—section of the road with the marking of the degraded unmilled surface, the surface after milling the first layer of material and the desired target surface of the traffic area after the milling part of the repair

The method according to the invention can be carried out, for example, on the device shown in FIG. 1, which shows a road milling machine 1 with a fixed frame and a milling drum 9. The body of the road milling machine 1 and the milling drum 9 are tightly bound to frame of the road milling machine 1. Milling depths and slopes are realized by changing the height and tilting the entire frame using hydraulically extendable crawler sliders or wheels.

The road milling machine 1 Is equipped with a position sensor 2 and a inclination sensor 3. The position sensor 2 is a pair of GNSS receivers in the example shown. The first $GNSS_L$ receiver is located approximately above the left side of the milling drum 9, and the second $GNSS_R$ receiver is located approximately above the right side of the road milling machine 1. It is also possible to use other known systems for position sensing, for example a total station that aims at a reflecting prism or other target placed on the road milling machine 1 or a combination of a GNSS receiver to determine the horizontal position X, Y and a laser leveling device that measures the heights of the target on the road milling machine for determining the vertical Z position. The inclination sensor 3 is the inclination sensor that is standard equipment of the road milling machine 1, or an external inclination sensor located on the body or frame of the road milling machine 1 can be used.

The road milling machine 1 is also provided with a control unit 7 with a display device 6.

The position sensor 2 is connected to the 3D guidance computer 4, the inclination sensor 3, which is a standard part of the road milling machine, is connected to the road milling machine control computer 10, and the road milling machine control computer 10 is connected to the 3D guidance computer 4.

A database 5 is connected to the 3D guidance computer 4 for storing all data, especially position and slope data, a digital 3D model of the surface 12 of the traffic area after milling the first layer, and a digital differential model of the milling depths. In the described embodiment, the control unit 7, the display device 6, the 3D guidance computer 4 and the database 5 are made up of one common outdoor computer Panasonic Toughpad FZ-G1 with an Intel i5-4310U 2.00 GHZ processor, with an 8 GB operating memory, a database made up of an SSD disk with a capacity of 128 GB. The display and control unit is a touchscreen display with a diagonal of 10.1".

The data stored in the database 5 of computer 4 3D guidance can be used for various analyses, e.g. for the purpose of documentation of the work carried out on individual layers of the road, for the purpose of objective evaluation of the quality of the work carried out, for the purpose of planning subsequent phases of repair or future new repair of the road, where the spatial distribution of the structural layers is used, for example, to design the depths and slopes of milling with a road milling machine or to design the thickness and slopes of laying a new structural layer with a road paver.

The server 8 is also connected to the 3D guidance computer 4. In the described example embodiment, the server 8 is a computer with an AMD Ryzen 7 5700G 4.6 GHz processor, an AMD Radeon Graphics graphics card, 32 GB DDR4 RAM and a 2000 GB SSD. The server 8 is used to design a digital 3D model of the desired target surface 13 of the traffic area after the milling part of the repair and to calculate a digital differential model of the milling depths, which for each X, Y coordinate of the surface 12 of the traffic area after milling the first layer in an absolute coordinate system independent of the road milling machine 1 (for example in the UTM coordinate system) defines the milling depth Ft (X,Y) from the surface 12.

The 3D guidance computer 4 and the database 5, possibly also the display device 6 and the control unit 7 can advantageously be formed by one physical element, for example an industrial computer or a tablet.

Figure 2:
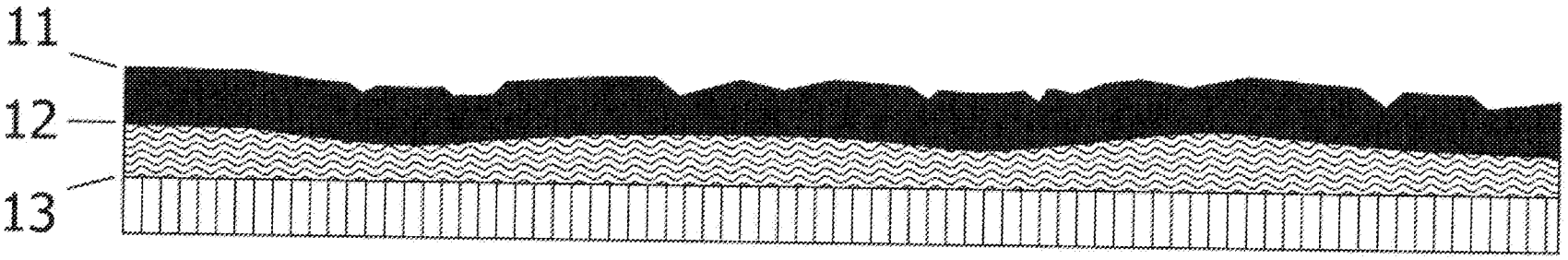

FIG. 2 shows a section of the road with the marking of the original degraded unmilled surface 11 before the repair, then the surface 12 after the milling of the first layer of material, and at the same time the required target surface 13 of the traffic area after the milling part of the repair is also marked.

The milling of the surface of the traffic area described in the example of the method according to the invention takes place in two layers.

During the milling of the first layer, the spatial position X, Y, Z of the GNSS receiver antennas ($XYZ_{GNSS\text{-}L}$, $XYZ_{GNSS\text{-}R}$) is continuously acquired in an absolute coordinate system independent of the road milling machine 1 (e.g. in the UTM coordinate system with ellipsoidal heights).

Simultaneously with the inclination sensor 3, it continuously senses the cross slope of the road milling machine 1 and thus of the milling drum 9.

Position and inclination sensing is continuous for each milling point and time instant for all milling runs until the entire desired area is milled, e.g. a two-lane road.

In addition, additional design information, if known, is obtained to refine the final design of the digital 3D model of the desired target surface 13 of the traffic area after the milling part of the repair. For example, information on which milling passes will be milled with variable milling depth and milling cross slope during the milling of the second layer to achieve the desired longitudinal smoothness and cross slopes, which trajectories are also the boundary of the digital models, and which trajectories form the crown of the road and other break lines where there will be a change in cross slope in the new design. Furthermore, information on the maximum, minimum and optimal milling depths, on the maximum, minimum and optimal slopes and on the permitted milling depth for connected objects (such as curbs, sewer drains and drainage manhole rings) and their X, Y position. Alternatively, information on longitudinal flatness, for example in the form of requirements to achieve an IRI (international roughness index) value and the required amount of material to be milled.

This additional design information can be entered by the operator of the road milling machine 1 using the display device 6 and the control unit 7 and stored in the database 5.

On the basis of the obtained data on the spatial position of $XYZ_{GNSS\text{-}L}$, $XYZ_{GNSS\text{-}R}$ and the cross slope of the road milling machine 1, a digital 3D model of the surface 12 of the traffic area after milling the first layer is calculated, for example in the following way.

From the measured spatial positions of the antennas of the GNSS receivers ($XYZ_{GNSS\text{-}L}$, $XYZ_{GNSS\text{-}R}$) and from the obtained pre-measured transverse, longitudinal and height offsets of the GNSS antennas from the left and right sides of the working part of the milling drum 9 and obtained or calculated transverse and longitudinal inclines of the road milling machine 1 (roll, pitch), the approximate coordinates $XYZ_L$ and $XYZ_R$ of the left and right sides of the working part of the milling drum 9 are calculated in a global coordinate system independent of the road milling machine 1 (for example, in the UTM coordinate system with ellipsoidal heights). This results in sets of discrete points that represent the raw trajectories of the left and right working parts of the milling drum 9 $XYZ_L$ and $XYZ_R$.

Depending on the type of milling machine and the chosen milling method, a suitable approximation method is selected to approximate the individual raw trajectories $XYZ_L$, $XYZ_R$. For example, a Kalman filtering or a spline function approximation is used. The resulting continuous curves are individually discretized with a sampling frequency of, for example, 5 centimeters. Thus, sets of discrete points representing the approximate trajectories of the left and right working parts of the milling drum 9 $XYZ_L'$ and $XYZ_R'$ are obtained.

The adjacent approximate trajectories from overlapping milling passes of adjacent milling runs are averaged so that the points of the approximate trajectories realized by earlier runs are first shifted by calculation to the position of the trajectory realized by a later milling runs based on the known cross slope of milling in each station of the individual runs, and then the points of both trajectories are averaged by a weighted average. The weights are chosen according to the known, calculated or estimated positional accuracies of the discrete points of the approximated trajectories that are averaged in this step. The resulting continuous curves are individually discretized again with a sampling frequency of, for example, 5 centimeters. Thus, sets of discrete points representing the averaged trajectories of the left and right working parts of the milling drum 9 $XYZ_L''$ and $XYZ_R''$ are obtained.

The resulting averaged $XYZ_L''$ and $XYZ_R''$ and approximated $XYZ_L'$ and $XYZ_R'$ trajectories that have not been averaged (for example, trajectories at the outer edges of the road), specifically the discrete points of these two types of trajectories, are recomputed by shifting them to a common location, for example, the crown of a road on a known cross slope and a known width of the milling drum or a known distance between trajectories from the calculated approximated trajectories, where they are jointly approximated by a suitable algorithm, for example, using Kalman filtering or approximation by an approximating spline function. The resulting continuous curve is again discretized with a sampling frequency of, for example, 5 centimetres. The discrete points of this resulting common approximated curve are calculated to gradually move back to the locations of the original raw trajectories based on the known cross slopes at each station of the trajectories and the width of the milling drum or the known distance between individual trajectories from the calculated approximated trajectories. Thus, sets of discrete points representing the adjusted trajectories of the left and right working parts of the milling drum 9 $XYZ_L'''$ $XYZ_R'''$ in all milling passes are obtained.

The adjusted coordinates of the trajectory points of the left and right working parts of the milling drum $XYZ_L'''$ and $XYZ_R'''$ are used to create a digital 3D model of the surface 12 after milling the first layer of material.

In addition to information about the spatial position (X, Y, Z) of the road milling machine and the cross slope of the milling drum, information about the relative positional changes of the road milling machine from an inertial navigation system located on the road milling machine can also be used to calculate a digital 3D model of the surface of the traffic area after the first layer 12 has been milled. An inertial navigation system is a navigation device that uses a computer, motion sensors (accelerometers) and rotational sensors (gyroscopes) to continuously calculate the position, orientation and velocity (direction and speed of motion) of a moving object without the need for external references. Specifically, Information from the inertial navigation system is used, for example, to determine the parameters of an approximation function for smoothing the horizontal and vertical components of the trajectories of the left and right working parts of the milling drum 9 $XYZ_L$ and $XYZ_R$, or more generally to refine the determination of the spatial position (X, Y, Z) of the road milling machine 1.

To calculate the digital 3D model of the surface of the traffic area after milling the first layer 12, in addition to the information on the spatial position (X, Y, Z) of the road milling machine and the cross slope of the milling drum, information about the relative longitudinal height profile of the original degraded unmilled surface of the traffic area 11 or information about the relative longitudinal height profile of the surface 12 of the traffic area after milling off the first layer of material can also be used. These profiles are continuously measured during milling, for example by a Wirtgen multiplex system device, and the values are transmitted via a communication interface from the control computer 10 of the milling machine to the 3D guidance computer 4. Specifically, the relative longitudinal height profile information is used, for example, to determine the parameters of an approximation function for smoothing the vertical component of the trajectories of the left and right working parts of the milling drum 9 $XYZ_L$ and $XYZ_R$.

To calculate the digital 3D model of the surface of the traffic area after milling the first layer 12, In addition to the information on the spatial position (X, Y, Z) of the road milling machine and the cross slope of the milling drum, information about the travel speed and rotation of the crawler sliders or wheels of the road milling machine can also be used, which are transmitted through the communication interface from the control computer of the road milling machine the 3D guidance computer or obtained from external sensors, such as an odometer, which are connected to the 4 3D guidance computer. Information on the travel speed and rotation of the crawler sliders or wheels of the road milling machine is specifically used, for example, to determine the parameters of the approximation function for smoothing the horizontal component of the trajectories of the left and right working parts of the milling drum 9 $XYZ_L$ and $XYZ_R$.

In all approximations and weighted averaging, the known, calculated or estimated positional accuracies of the individual points are used to set the weights.

Full procedure for calculating adjusted discrete points $XYZ_L'''$ $XYZ_R'''$ from the original sensed spatial positions X, Y, Z of the GNSS receiver antennas ($XYZ_{GNSS\text{-}L}$, $XYZ_{GNSS\text{-}R}$) can be realized by a complex calculation in three-dimensional space or the calculation can be divided into separate solutions in two dimensions representing the horizontal component and in one dimension representing the vertical component.

The calculated digital 3D model of the surface 12 of the traffic area after milling the first layer of material is sent, together with additional design information, to the server 8, where a the desired target surface 13 of the traffic area after the milling part of the repair is calculated. For example, Autocad Civil or Bentley OpenRoads software can be used to calculate this 3D model.

Based on the digital 3D model of the surface 12 of the traffic area after milling the first layer of material and the design of the 3D model of the desired target surface 13 of the traffic area after the milling part of the repair, a digital differential model of milling depths is calculated on the server 8 which defines for each X, Y coordinate a milling depth Ft(X,Y).

The digital differential model of the milling depths is sent from the server 8 back to the 3D guidance computer 4 and stored in the database 5.

During the milling of the second layer, the 3D guidance computer 4 obtains information about the horizontal X, Y positions of the left and right GNSS antennas and based on the transverse, longitudinal and height offsets of the GNSS antennas from the left and right sides of the working part of the milling drum 9 and based on the obtained or calculated information about transverse and longitudinal inclinations of milling machine 1 (roll, pitch), a $XY_L$ and $XY_R$ coordinates of the left and right sides of the working part of the milling drum 9 in a global coordinate system independent of the milling machine 1 are calculated, and the milling depths Ft(X,Y) for the left and right working parts of the milling drum 9 are determined from the digital differential model.

The depths Ft (X,Y) are continuously sent via a communication interface from the 3D guidance computer 4 to the road milling machine control computer 10, The road milling machine control computer 10 controls the hydraulics of the road milling machine 1 so that the depth Ft(X,Y) is milled.

According to another embodiment of the method according to the invention, the 3D model of the desired target surface 13 of the traffic area after the milling part of the repair is used for absolute guidance of the road milling machine 1, for example using Topcon mmGPS technology.

LIST OF REFERENCE SIGNS

1 Road milling machine
2 Position sensor of the road milling machine
3 Inclination sensor of the road milling machine
4 3D guidance computer
5 Database
6 Display device

7 Control unit
8 Server
9 Milling drum
10 Road milling machine control computer
11 Original degraded unmilled surface of the traffic area
12 Surface of the traffic area after milling the first layer of material
13 Desired target surface of the traffic area after the milling part of the repair

The invention claimed is:

1. A method of milling a surface of a traffic area in at least two layers, characterized in that a first layer is milled and at the same time a spatial position (X, Y, Z) of a road milling machine and a cross slope of a milling drum are measured continuously at each moment of milling the first layer and the measured data are stored in a database connected to a 3D guidance computer, from the stored measured data representing the spatial positions (X, Y, Z) of the road milling machine and the cross slopes of the milling drum, a digital 3D model of the surface of the traffic area after milling the first layer is calculated in a 3D guidance computer for calculation of 3D models of surface of traffic area selected from the group comprising of the 3D guidance computer and a server connected to the 3D guidance computer and a server integrated in one device with the 3D guidance computer, subsequently, at least a second layer is milled after the first layer is milled using the digital 3D model of the surface of the traffic area after milling the first layer and the obtained digital 3D model of the desired target surface of the traffic area after the milling part of the repair or obtained a digital differential model of milling depths, before milling the second layer, the calculated digital 3D model of the surface of the traffic area after milling the first layer is sent to the server, and the server calculates a digital 3D model of the desired target surface of the traffic area after milling part of the repair from the calculated digital 3D model of the surface of the traffic area after milling the first layer and from additional design information.

2. The method according to claim 1, characterized in that, in addition to information about the spatial position (X, Y, Z) of the road milling machine and the cross slopes of the milling drum, information about the relative positional changes of the road milling machine from an inertial navigation system mounted on the road milling machine is also used to calculate a digital 3D model of the surface of the traffic area after milling the first layer.

3. The method according to claim 1, characterized in that, in addition to information about the spatial position (X, Y, Z) of the road milling machine and the cross slopes of the milling drum, information about the relative longitudinal height profile of the original degraded unmilled road surface or information about the relative longitudinal height profile of the road surface after milling the first layer of material, which is continuously measured during milling, is also used to calculate the digital 3D model of the road surface after milling the first layer of material.

4. The method according to claim 1, characterized in that, in addition to information about the spatial position (X, Y, Z) of the road milling machine and the cross slopes of the milling drum, information about the travel speed and the rotation of the crawler sliders or the wheels of the road milling machine is also used to calculate the digital 3D model of the surface of the traffic area after milling the first layer, which is transmitted via a communication interface from the road milling machine control computer to the 3D guidance computer or obtained from external sensors, such as an odometer, which are connected to the 3D guidance computer.

5. Method according to claim 1, characterized in that subsequently, the digital differential model of the milling depths is calculated in the server from a digital 3D model of the surface of the traffic area after milling the first layer and from a digital 3D model of the desired target surface of the traffic area after the milling part of the repair, which defines a milling depth Ft (X, Y) for each X, Y coordinate, the digital differential model of the milling depths is sent from the server and stored in the database connected to the 3D guidance computer, then the second layer of the traffic area is milled, and during the milling of the second layer the 3D guidance computer obtains the horizontal coordinates (X,Y) of the road milling machine and determines the appropriate milling depth Ft° (X,Y) from the digital differential model of the milling depths, and the depth Ft (X,Y) is sent to a road milling machine control computer via the communication interface, and the road milling machine control computer controls the road milling machine so that the depth Ft (X,Y) is milled.

6. Method according to claim 5, characterized in that the data stored in the database are used for various analyses including for the purpose of documentation of the work carried out on individual layers of the road, for the purpose of objective evaluation of the quality of the work carried out, or for the purpose of planning subsequent phases of repair or future new repair of the road, where the spatial distribution of the structural layers is used to design depths and slopes of milling with a road milling machine or to design the thickness and slopes of laying a new structural layer with a road paver.

7. The method according to claim 1, characterized in that the server and the 3D guidance computer are integrated in one device.

8. The method according to claim 1, characterized in that a road milling machine control computer and the 3D guidance computer are integrated in one device.

* * * * *